US006206790B1

(12) United States Patent
Kubica et al.

(10) Patent No.: US 6,206,790 B1
(45) Date of Patent: Mar. 27, 2001

(54) IRON TYPE GOLF CLUB HEAD WITH WEIGHT ADJUSTMENT MEMBER

(75) Inventors: Daniel J. Kubica, Phoenix; Parvaneh Kazemi-Tabrizi, Scottsdale, both of AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/346,287

(22) Filed: Jul. 1, 1999

(51) Int. Cl.[7] ..... A63B 53/04
(52) U.S. Cl. ..... 473/335; 473/349; 473/350
(58) Field of Search ..... 473/324, 334, 473/335, 336, 337, 338, 339, 349, 350, 256

(56) References Cited

U.S. PATENT DOCUMENTS 1,320,163 * 10/1919 Maurice .
3,749,408 * 7/1973 Mills .
3,814,437 * 6/1974 Winquist .
4,326,326 * 4/1982 MacDonald .
4,754,977 7/1988 Sahm .
4,883,274 * 11/1989 Hsien .
5,014,993 5/1991 Antonious .
5,048,834 9/1991 Gorman .
5,104,457 * 4/1992 Viljoen .
5,242,167 * 9/1993 Antonious .
5,385,348 * 1/1995 Wargo .
5,395,113 3/1995 Antonious .
5,588,923 12/1996 Schmidt et al. .
5,590,881 * 1/1997 Jernigan .
5,658,208 * 8/1997 Shimasaki .
5,658,209 * 8/1997 Blakemore .

* cited by examiner

*Primary Examiner*—Sebastiano Passaniti
(74) *Attorney, Agent, or Firm*—Darrell F. Marquette

(57) ABSTRACT

An iron type golf club head includes a body having a front face arranged for impact with a golf ball, a back face, a heel portion and toe portion. A perimeter weighting element protrudes rearwardly from the front face and defines a primary cavity in the back face of the body. The perimeter weighting element includes a top rail and a sole which extend between the body heel and toe portions along an upper portion and a lower portion, respectively, of the body. An interior wall extends from a first end located adjacent the body heel portion through the primary cavity between the top rail and the sole to a second end located adjacent the body toe portion. The interior wall defines a secondary cavity within the primary cavity, and a weight adjustment member is disposed in the secondary cavity. The weight adjustment member is selected from a plurality of weight adjustment members and is used to overcome manufacturing tolerances and to adjust golf club swingweights.

6 Claims, 4 Drawing Sheets

IRON TYPE GOLF CLUB HEAD WITH WEIGHT ADJUSTMENT MEMBER

BACKGROUND OF THE INVENTION

This invention relates generally to golf equipment and, in particular, to an iron type golf club head with a weight adjustment member.

U.S. Pat. No. 5,588,923 to G. H. Schmidt et al discloses apparatus for adjusting swing weights of iron type golf clubs. This apparatus consists of a composite member attached to the back side of a club head having a weight adjusting layer and a graphics layer. The weight adjusting layer may be adhesive tape with metal (such as lead or tungsten) particles dispersed therein. The graphics layer may be a thin plastic sheet. Composite members are provided in different weights (for example, two, four, six and eight grams) so that the swing weight of a particular golf club may be adjusted as desired.

SUMMARY OF THE INVENTION

An iron type golf club head includes a body having a front face arranged for impact with a golf ball, a back face, a sole, a top rail, a heel portion and a toe portion. A perimeter weighting element protrudes rearwardly from the front face and defines a cavity in the back face. The perimeter weighting element includes a top rail and a sole which extend between the body heel and toe portions along an upper portion and a lower portion, respectively, of the body. An interior wall extends from a first end located adjacent the body heel portion through the primary cavity between the top rail and the sole to a second end located adjacent the body heel portion defining a secondary cavity within the primary cavity. A weight adjustment member is disposed in the secondary cavity. The interior wall first end is connected to the perimeter weighting element adjacent the body heel portion and interior wall second end is connected to the perimeter weighting element adjacent the body toe portion.

DESCRIPTION OF THE PREFERRED EMBODIMENT

Figure 2:
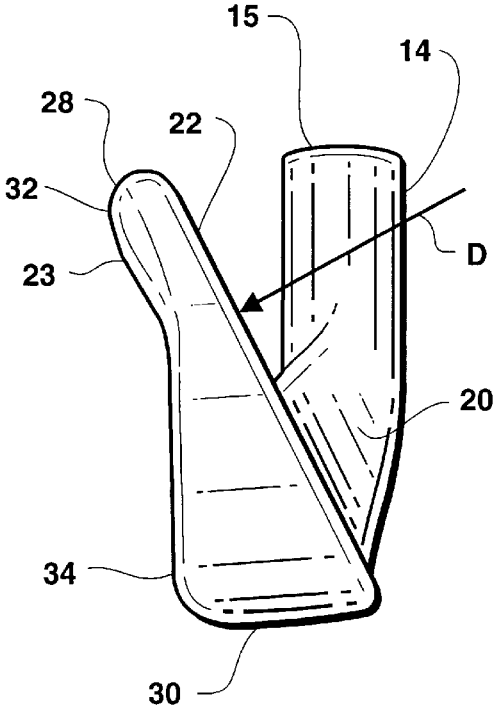
FIG. 2 is a toe end view of the golf club head of FIG. 1.
Figure 3:
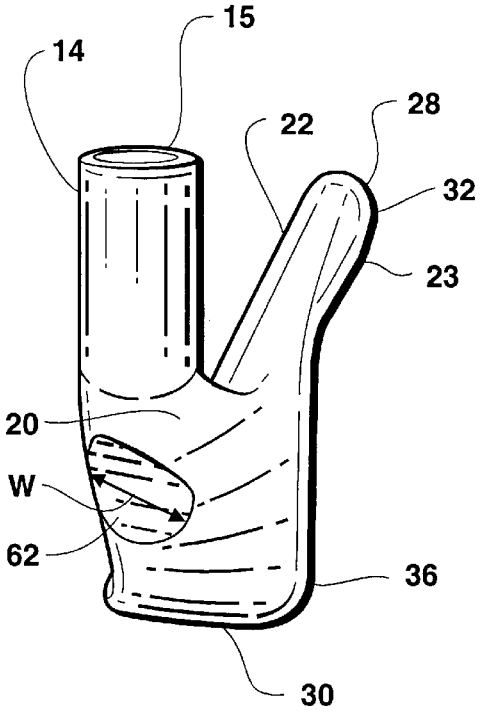
FIG. 3 is a heel end view of the golf club head of FIG. 1.
Figure 4:
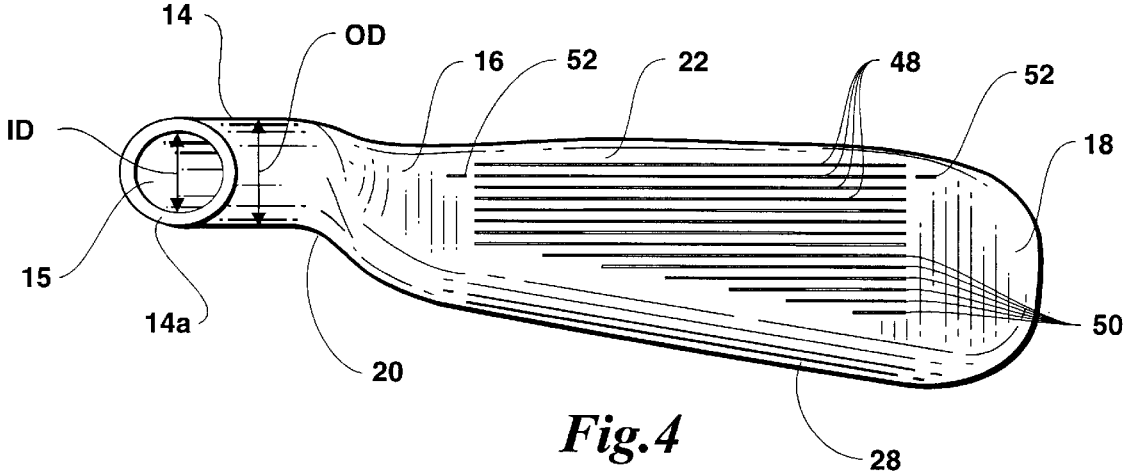
FIG. 4 is top view of the golf club head of FIG. 1.
Figure 5:
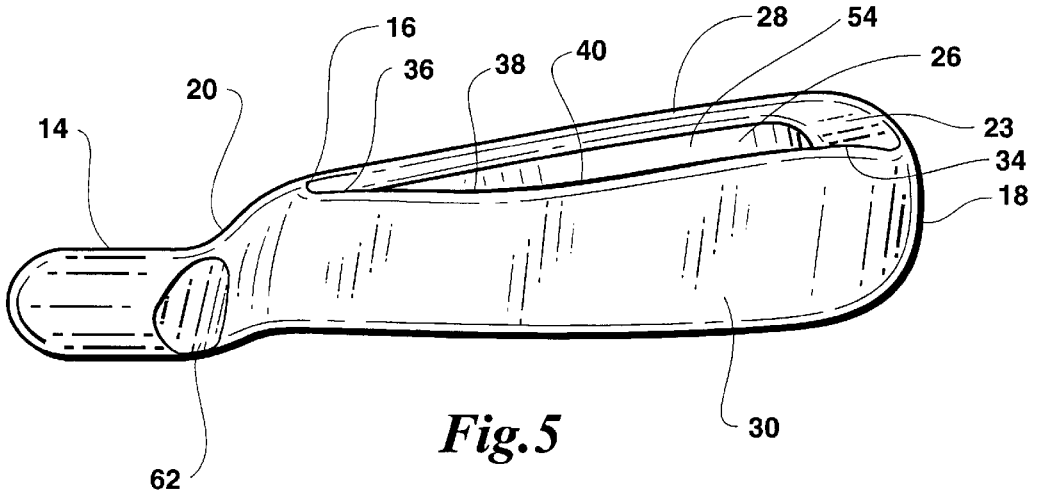
FIG. 5 is a bottom view of the golf club head of FIG. 1.
Figure 6:
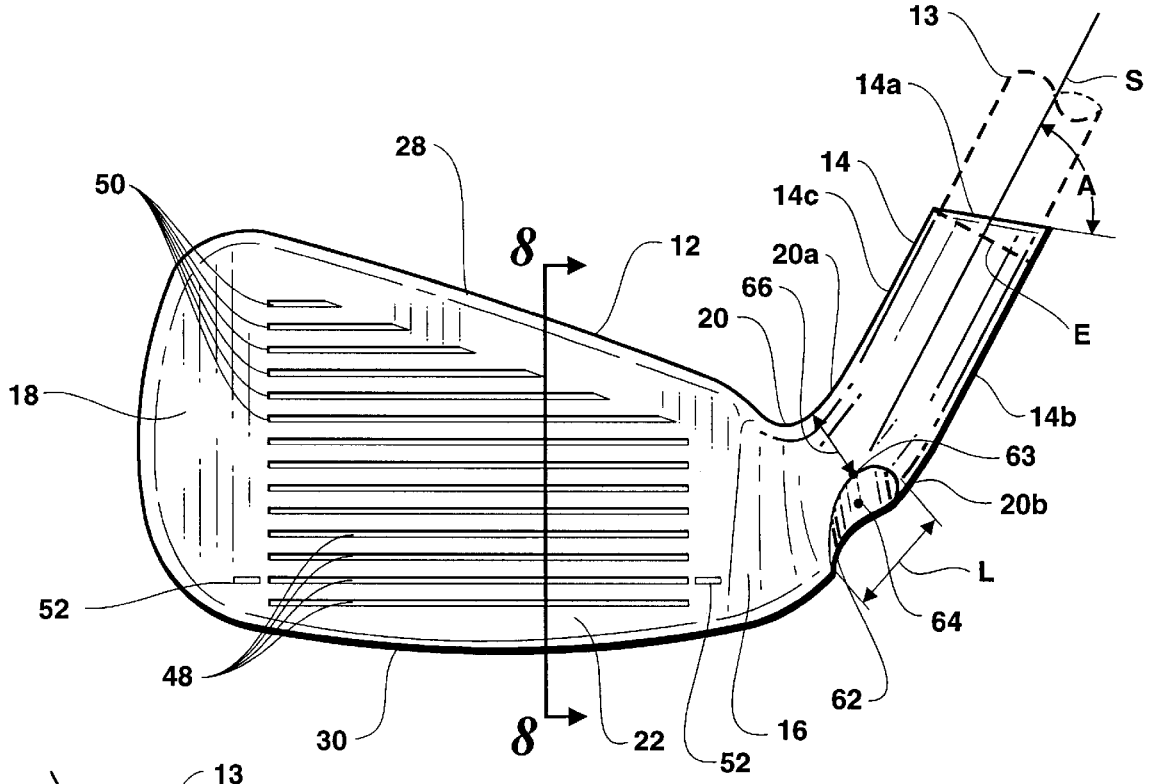
FIG. 6 is a front elevational view of the golf club head of FIG. 1.

Referring to FIGS. 1–7, an iron type golf club head 10 includes a body 12 and a hosel 14 containing a cylindrical bore 15 for receiving one end of a golf club shaft 13 (FIG. 6). The hosel 14 has an inside diameter ID and an outside diameter OD as best seen in FIG. 4. Although the club head 10 is shown as a five-iron, it could also be any iron-type club head from a one-iron to a wedge. The body 12 has a heel portion 16 and a toe portion 18 that are spaced apart. The hosel 14 includes a neck 20 connected to the heel portion 16 of the body 12. The club head 10 is preferably cast from suitable metal such as stainless steel. A front face 22 arranged for impact with a golf ball (not shown) is provided on the body 12 and extends between the body heel and toe portions 16, 18 along a frontal portion of the body 12. Disposed rearwardly of the front face 22 is a back face 23. When viewed as in FIG. 6 from a direction D (FIG. 2) which is generally normal to the front face 22, the neck 20 has an upper surface 20*a* and a lower surface 20*b*.

A perimeter weighting element 24 protrudes rearwardly from the front face 22 and defines a primary cavity 26 in the back face 23. The perimeter weighting element 24 includes a top rail 28 and a sole 30. The primary cavity 26 is defined at its upper extremity by the top rail 28 and at its lower extremity by the sole 30. The top rail 28 extends between the body heel and toe portions 16, 18 along an upper portion of the body 12, and the sole 30 extends between the body heel and toe portions 16, 18 along a lower portion of the body 12. The perimeter weighting element 24 also includes an upper toe weight 32 adjacent a toe end of the top rail 28, a lower toe weight 34 adjacent a toe end of the sole 30, and a lower heel weight 36 adjacent a heel end of the sole 30. The toe portion 18 of the body 12 has a back edge 19 that is indented toward the front face 22 between the top rail 28 and sole 30 separating the upper toe weight 32 from the lower toe weight 34.

The upper and lower toe weights 32, 34 and the lower heel weight 36 provide the club head 10 with resistance to twisting movement about a vertical axis through the body 12 as a result of the front face 22 impacting a golf ball near the heel portion 16 or the toe portion 18 of the body 12. The sole 30 has a lower trailing edge 38 that includes an indentation 40 (FIG. 5) between the lower heel and toe weights 34, 36 as described in U.S. Pat. No. 4,621,813 to Karsten Solheim. Located adjacent the lower trailing edge 38 of the sole 30 is a lower backsurface 42 of the perimeter weighting element 24. This lower backsurface 42 preferably slopes upwardly and inwardly from the trailing edge 38 toward the front face 22. The lower backsurface 42 merges with a lower inner surface 44 of the perimeter weighting element 24 along an upper trailing edge 46 of the sole 30. The indentation 40 and the sloping orientation of the lower backsurface 42 serve to redistribute material in the body 12 in a manner that increases the relative sizes of the lower heel and toe weights 34, 36 thereby increasing the resistance of the club head 10 to the above-mentioned twisting movement.

As seen in FIGS. 4 and 6, grooves 48, 50 are formed in the front face 22 of the body 12. The grooves 48, 50 are elongated in a direction extending between the heel and toe portions 16, 18 of the body 12 and include a set of grooves 48 of equal length and a set of grooves 50 of varying length. A pair of visual indicators 52 such as disclosed in U.S. Pat. No. 5,643,099 to J. A. Solheim may be provided on the front face 22.

Figure 1:
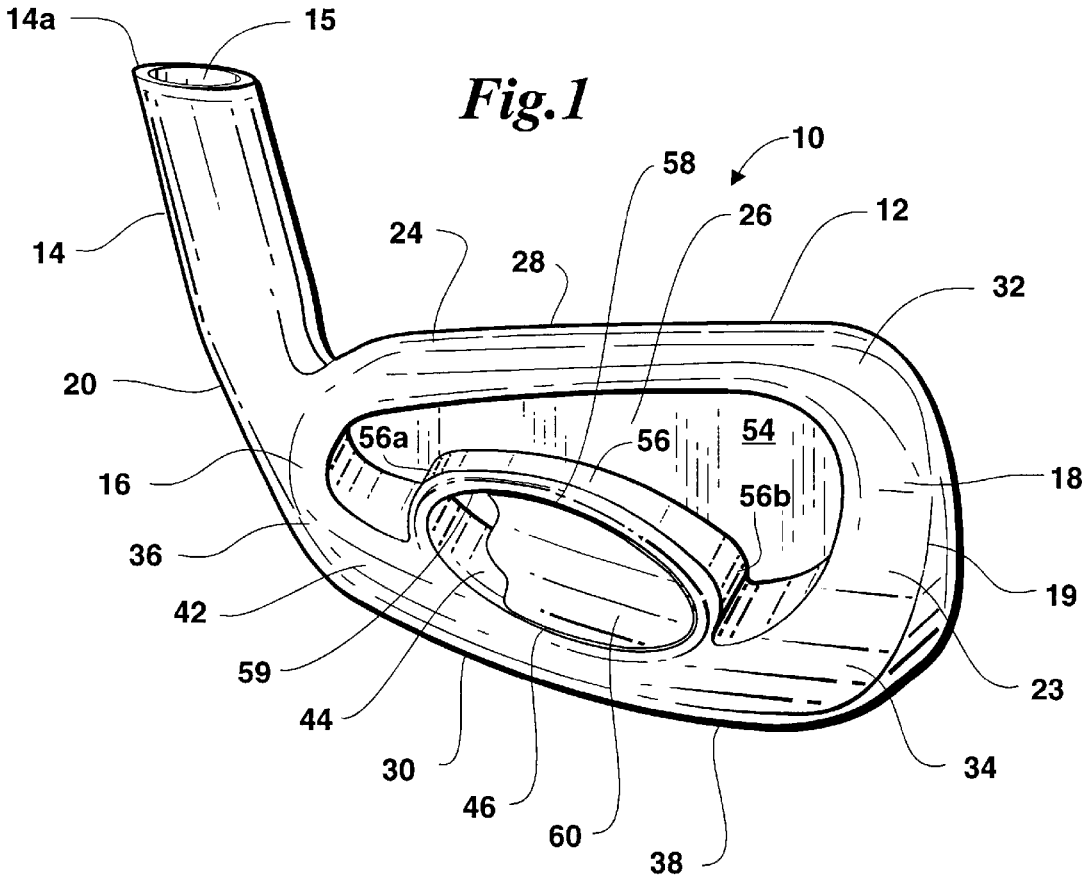
FIG. 1 is a perspective view of an iron type golf club head embodying a weight adjustment member according to the present invention.
Figure 7:
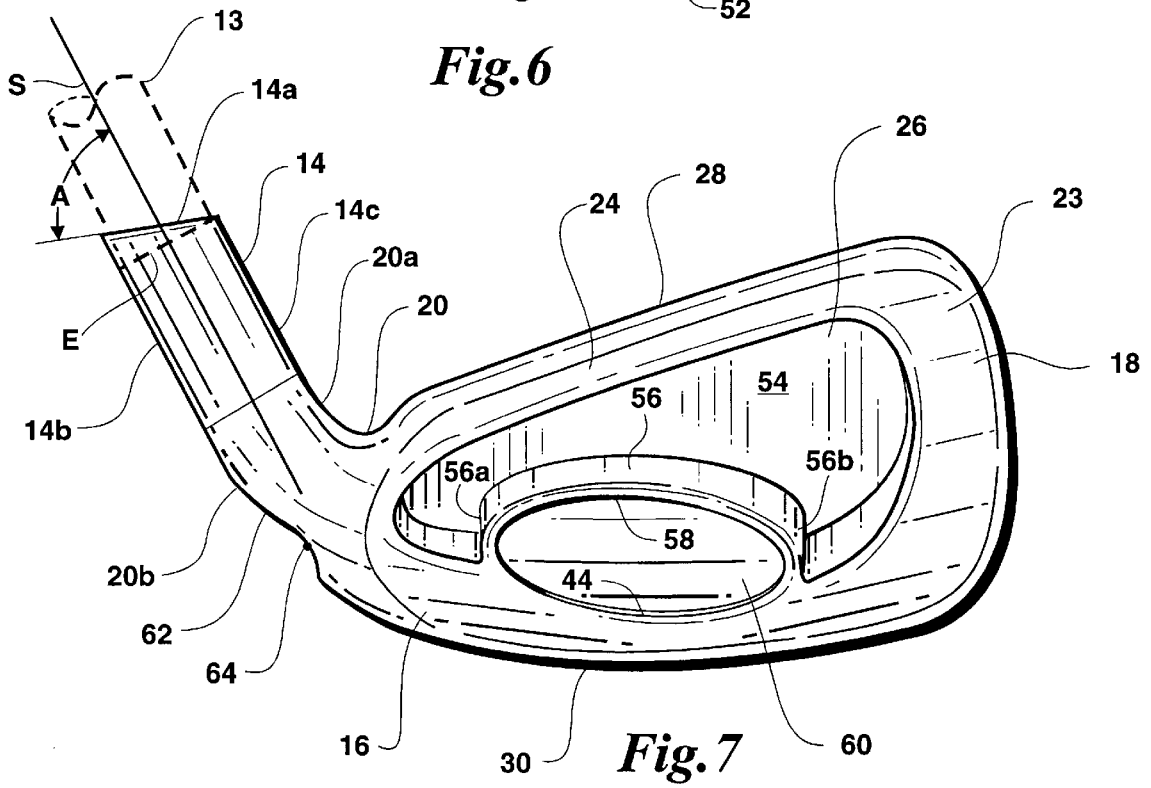
FIG. 7 is a rear elevational view of the golf club head of FIG. 1.
Figure 8:
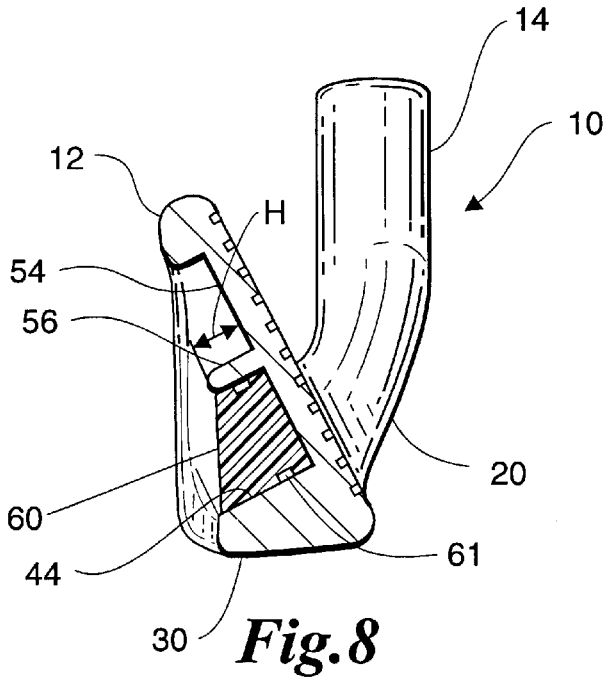
FIG. 8 is a sectional view taken along lines 8—8 in FIG. 6.

The primary cavity 26 defined by the perimeter weighting element 24 has a bottom surface 54. Formed integrally on the primary cavity bottom surface 54 is an interior wall 56 that extends from a first end 56*a* located adjacent the body heel portion 16 through the primary cavity 26 between the top rail 28 and the sole 30 to a second end 56*b* located adjacent the body toe portion 18. The first and second ends 56*a*, 56*b* of the interior wall 56 are integrally connected to the perimeter weighting element 24 adjacent the body heel and toe portions 16, 18 defining a secondary cavity 58 within the primary cavity 26. The inner surface 44 of the perimeter weighting element 24 is disposed between the first and second ends 56*a*, 56*b* of the interior wall 56 and forms a lower extremity of the secondary cavity 58. An inner surface 59 of the interior wall 58 forms an upper extremity of the secondary cavity 58. The interior wall 56 has a height dimension H (FIG. 8) that varies between its first and second ends 56*a*, 56*b* as seen in FIGS. 1 and 7. It will be understood that the height dimension H of the interior wall 56 is greater at the second end 56*b* which is adjacent the body toe portion 18 than at the first end 56*a* which is adjacent the body heel portion 16.

A weight adjustment member 60 (partially broken away in FIG. 1) having a predetermined volume is disposed in the secondary cavity 58 and is secured therein by suitable adhesive such as epoxy. The weight adjustment member 60 is selected from a plurality of weight adjustment members (not shown) that have the same predetermined volume but have different densities and thus different weights. This plurality of weight adjustment members preferably covers a range from about four grams to about thirty grams in one gram increments. This range of weights should be sufficient to cover different shaft lengths and different types of shafts that may be attached to the club head 10. Therefore, the desired weight of the club head 10 may be adjusted without changing the predetermined volume of the weight adjustment member 60. By selecting a weight adjustment member 60 of proper weight, manufacturing tolerances can be overcome and the swingweight of a golf club may be adjusted. The weight adjustment member 60 is preferably formed of plastic. Since the weight adjustment member 60 is located near the center of gravity of the club head 10, the club head center of gravity will not change significantly when selecting any of the plurality of weight adjustment members.

Figure 9:
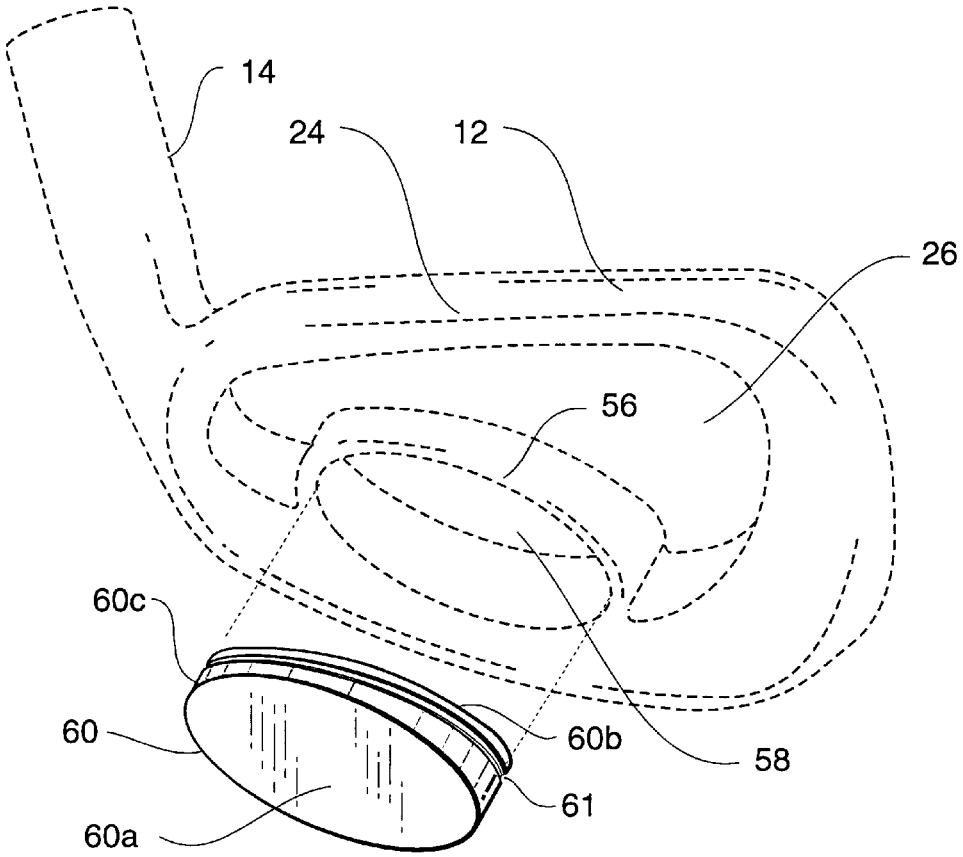
FIG. 9 is an exploded view of the golf club head of FIG. 1.

As shown in FIG. 9, the weight adjustment member 60 has a top surface 60*a*, a bottom surface 60*b*, and a side surface 60*c* extending between the top and bottom surfaces 60*a*, 60*b*. A groove 61 formed in the side surface 60*c* extends peripherally of the weight adjustment member 60. In order to secure the weight adjustment member 60 in the secondary cavity 58, epoxy is applied to the bottom surface 60*b* thereof. Any excess epoxy collects in the groove 61 and is prevented from being pushed out of the secondary cavity 58.

In order to provide loft and lie adjustment of the club head 10, a notch 62 having a depth that varies along its length L is formed in the lower surface 20*b* of the neck 20. As seen in FIG. 3, the notch 62 has a maximum width dimension W that is substantially perpendicular to the front face 22. It will be understood that the maximum width dimension W of the notch 62 could be arranged at various angles to the front face 22 and, therefore, is not limited to being arranged as shown in FIG. 3. The notch 62 has a point of maximum depth 64 (FIGS. 6 and 7) preferably located on its maximum width dimension W. A critical dimension 66 (FIG. 6) measured between the upper surface 20*a* of the neck 20 and a point 63 on the depth of the notch 62 is less than the outside diameter OD of the hosel 14. This critical dimension 66 allows bending of the hosel 14 to occur only at the neck 20 with no bending of the portion of the hosel 14 containing the bore 15. The notch 62 may be positioned so that points 63 and 64 coincide if desired.

Referring to FIGS. 6 and 7, the hosel 14 has a top edge 14*a* that is disposed at an acute angle A of approximately 60 to 80 degrees with respect to the longitudinal axis S of the shaft 13 when viewed from the direction D (FIG. 2). This acute angle A significantly increases the cross sectional area of the shaft 13 at the top edge 14*a* of the hosel 14 thereby reducing shaft stress at the hosel top edge 14*a*. In a prior art club head such as shown in U.S. Pat. No. 4,512,577, the hosel 14 would have a top edge E that is perpendicular to the longitudinal axis S of the shaft 13. This prior art arrangement results in the smallest possible cross sectional area of the shaft 13 at the hosel top edge E, and consequently the highest shaft stress. Also, it will be understood that the hosel top edge 14*a* is oriented so that the hosel 14 has more mass on its heel side 14*b* than on its toe side 14*c*. This distribution of material in the hosel 14 increases the moment of inertia of the club head 10.

What is claimed is:

1. An iron type golf club head comprising:

a body having a front face arranged for impact with a golf ball, a back face, a heel portion and a toe portion;

a perimeter weighting element protruding rearwardly from said front face defining a primary cavity in said back face, said perimeter weighting element including a top rail extending between said heel and toe portions along an upper portion of said body, said perimeter weighting element also including a sole extending between said heel and toe portions along a lower portion of said body, an interior wall extending from a first end connected to said perimeter weighting element adjacent said body heel portion through said primary cavity between said top rail and said sole to a second end connected to said perimeter weighting element adjacent the body toe portion defining a secondary cavity within said primary cavity, said interior wall having a height dimension that varies between said first and second ends thereof with said height dimension being greater at said second end than at said first end; and a weight adjustment member disposed in said secondary cavity.

2. The iron type golf club head of claim 1, wherein said primary cavity has a bottom surface, and wherein said interior wall is integrally formed on said bottom surface of said primary cavity.

3. The iron type golf club head of claim 1, wherein said weight adjustment member is selected from a plurality of weight adjustment members of different weights.

4. In an iron type golf club head including a body having a front face arranged for impact with a golf ball, a back face, a heel portion, a toe portion, a perimeter weighting element protruding rearwardly from said front face defining a primary cavity in said back face, said perimeter weighting element including a top rail extending between said heel and toe portions along an upper portion of said body, said perimeter weighting element also including a sole extending between said heel and toe portions along a lower portion of said body, the improvement comprising:

an interior wall extending from a first end connected to said perimeter weighting element adjacent said body heel portion through said primary cavity between said top rail and said sole to a second end connected to said perimeter weighting element adjacent the body toe portion defining a secondary cavity within said primary cavity, said interior wall having a height dimension that varies between said first and second ends thereof with said height dimension being greater at said second end than at said first end; and a weight adjustment member disposed in said secondary cavity.

5. In the iron type golf club head of claim 4, wherein said weight adjustment member comprises a top surface, a bottom surface, and a side surface extending between said top and bottom surfaces, and wherein a groove formed in said side surface extends peripherally of said weight adjustment member.

6. In the iron type golf club head of claim 5, wherein adhesive is applied to said bottom surface of said weight adjustment member in order to secure said weight adjustment member in said secondary cavity, and wherein any excess adhesive collects in said groove when said weight adjustment member is inserted in said secondary cavity.

* * * * *